US009437384B2

(12) United States Patent
Rizzo et al.

(10) Patent No.: US 9,437,384 B2
(45) Date of Patent: Sep. 6, 2016

(54) CIRCUIT BREAKER AND APPARATUS INCLUDING SLOT-RETAINED ARMATURE LINKAGE AND METHODS OF FABRICATING THE SAME

(71) Applicant: Eaton Corporation, Cleveland, OH (US)

(72) Inventors: Bradley Patrick Rizzo, Bethel Park, PA (US); Raymond Lee Jurek, Pittsburgh, PA (US); James Patrick Sisley, Baden, PA (US); David Edward Little, Midland, PA (US)

(73) Assignee: Eaton Corporation, Cleveland, OH (US)

( * ) Notice: Subject to any disclaimer, the term of this patent is extended or adjusted under 35 U.S.C. 154(b) by 145 days.

(21) Appl. No.: 14/326,540

(22) Filed: Jul. 9, 2014

(65) Prior Publication Data

US 2016/0012998 A1 Jan. 14, 2016

(51) Int. Cl.

| | |
|---|---|
| ***H01H 50/64*** | (2006.01) |
| ***H01H 71/24*** | (2006.01) |
| *H01H 71/10* | (2006.01) |

(52) U.S. Cl.

CPC ..... *H01H 50/643* (2013.01); *H01H 71/2472* (2013.01); *H01H 71/1009* (2013.01)

(58) Field of Classification Search

CPC ..... H01H 2071/749; H01H 2300/05; H01H 71/127; H01H 50/643; H01H 71/2472; H01H 71/1009; H01H 50/18; H01H 71/24; H01H 71/32; H01H 71/327

See application file for complete search history.

(56) References Cited

U.S. PATENT DOCUMENTS

| | | | | |
|---|---|---|---|---|
| 2,508,178 | A | 5/1950 | Lindstrom et al. | |
| 3,073,927 | A | 1/1963 | Hill et al. | |
| 3,258,561 | A | 6/1966 | Maier | |
| 3,758,887 | A | 9/1973 | Ellsworth et al. | |
| 3,906,414 | A | 9/1975 | Kidd et al. | |
| 3,949,331 | A | 4/1976 | Cellerini et al. | |
| 6,788,174 | B1 * | 9/2004 | Afshari | H01H 71/2472 335/176 |
| 9,058,951 | B2 * | 6/2015 | Augusta | H01H 77/06 |
| 2003/0053274 | A1 * | 3/2003 | Raabe | H01H 71/2472 361/93.8 |
| 2015/0179380 | A1 * | 6/2015 | Leung | H01H 50/18 335/42 |

FOREIGN PATENT DOCUMENTS

| | | | |
|---|---|---|---|
| WO | WO 2013100504 A1 * | 7/2013 | H01H 71/7463 |
| WO | WO 2015/094517 A1 | 6/2015 | |

OTHER PUBLICATIONS

International Search Report and Written Opinion Corresponding to International Application No. PCT/IB2015/055143; Date of Mailing: Oct. 20, 2015; 14 Pages.

* cited by examiner

*Primary Examiner* — Mohamad Musleh

(74) *Attorney, Agent, or Firm* — Myers Bigel & Sibley, P.A.

(57) ABSTRACT

A circuit breaker includes a frame, at least one conductor supported by the frame, and a breaker mechanism supported by the frame and including a trip bar assembly that actuates the breaker mechanism. The circuit breaker also includes a magnetic armature assembly including an armature plate configured to move responsive to a current in the at least one conductor and an elongate link member (e.g., a rod) coupling the armature plate to the trip bar and having at least one flanged portion retained in at least one keyed slot in at least one of the armature plate and the trip bar assembly. The elongate link member may have a narrowed portion sized to allow passage of the link member through a narrowed portion of the at least one keyed slot to facilitate engagement of the at least one flanged portion in the at least one keyed slot.

16 Claims, 6 Drawing Sheets

CIRCUIT BREAKER AND APPARATUS INCLUDING SLOT-RETAINED ARMATURE LINKAGE AND METHODS OF FABRICATING THE SAME

BACKGROUND

The inventive subject matter relates to circuit breakers and methods of fabricating the same and, more particularly, to circuit breakers with magnetic armature trip mechanisms and methods of fabricating the same.

A circuit breaker may include a trip mechanism with a magnetically-actuated armature that is used to actuate a breaker mechanism that separates contacts in the breaker to interrupt a circuit. In some breakers, the armature includes an armature plate or similar structure that is displaced by a magnetic force generated by a current flowing through a conductor (e.g., a bus bar) magnetically linked to the armature plate. Movement of the armature plate causes a trip bar coupled thereto to rotate, causing the breaker mechanism to open the breaker contacts.

In some breakers, the armature plate is coupled to the trip bar using a threaded rod running between the armature plate and the trip bar. It is desirable that this linkage be the proper length so that the breaker trips at a specified current level. Conventionally, this linkage is adjusted using hex nuts, stop nuts and/or other fasteners, which may complicate assembly of the breaker. For example, FIG. 7 illustrates a armature plate 10 that is linked to a trip bar 20 using a threaded rod 30 with a retaining nut 40. FIG. 8 illustrates a similar armature link, except an e-clip 50 is used to retain the end of the link rod 30.

SUMMARY

Some embodiments of the inventive subject matter provide a circuit breaker including a frame, at least one conductor supported by the frame, and a breaker mechanism supported by the frame and including a trip bar assembly that actuates the breaker mechanism. The circuit breaker also includes a magnetic armature assembly including an armature plate configured to move responsive to a current in the at least one conductor and an elongate link member coupling the armature plate to the trip bar and having at least one flanged portion retained in at least one keyed slot in at least one of the armature plate and the trip bar assembly. The elongate link member may have a narrowed portion sized to allow passage of the link member through a narrowed portion of the at least one keyed slot to facilitate engagement of the at least one flanged portion in the at least one keyed slot.

In some embodiments, the at least one keyed slot may include a first keyed slot in the armature plate and the at least one flanged portion may include a first flanged portion retained in the first keyed slot. The trip bar assembly may include a trip bar and a trip bar bracket attached to the trip bar, the at least one keyed slot may further include a second keyed slot in the trip bar bracket and the at least one flanged portion may further include a second flanged portion retained in the second keyed slot.

In further embodiments, the elongate link member may include a rod and the at least one flanged portion may be positioned proximate an end of rod. The at least one flanged portion may include a first flanged portion proximate a first end of the rod and a second flanged portion proximate a second end of the rod. The first flanged portion may be retained in a first keyed slot in the armature plate. The trip bar assembly may include a trip bar and a trip bar bracket attached to the trip bar, and the second flanged portion may be retained in a second keyed slot in the trip bar bracket. The rod may have a narrowed portion sized to allow passage of the link member through narrowed portions of the first and second keyed slots.

Some embodiments of the inventive subject matter provide a circuit breaker including a frame, at least one conductor supported by the frame and a breaker mechanism supported by the frame and including a trip bar and a trip bar bracket attached to the trip bar. The circuit breaker also includes a magnetic armature assembly supported by the frame and including an armature plate configured to move responsive to a current in the at least one conductor. The circuit breaker further includes a rod having a first flanged portion positioned at a first end thereof and retained in first keyed slot in the armature plate and a second flanged portion positioned at a second end of the rod and retained in a second keyed slot in the trip bar bracket.

Still further embodiments provide methods of fabricating a circuit breaker. The methods include engaging a flanged portion of an elongate link member in a keyed slot in an armature plate of an armature mechanism of the circuit breaker and attaching the elongate member to a trip bar of the circuit breaker to thereby mechanically couple the armature plate and the trip bar. Engaging the flanged portion of the elongate link member in the keyed slot in the armature plate may include engaging a first flanged portion of the elongate link member in the keyed slot in the armature plate. Attaching the elongate link member to the trip bar may include engaging a second flanged portion of the elongate link member in a keyed slot in a trip bar bracket and attaching the trip bar bracket to the trip bar.

DETAILED DESCRIPTION

Figure 1:
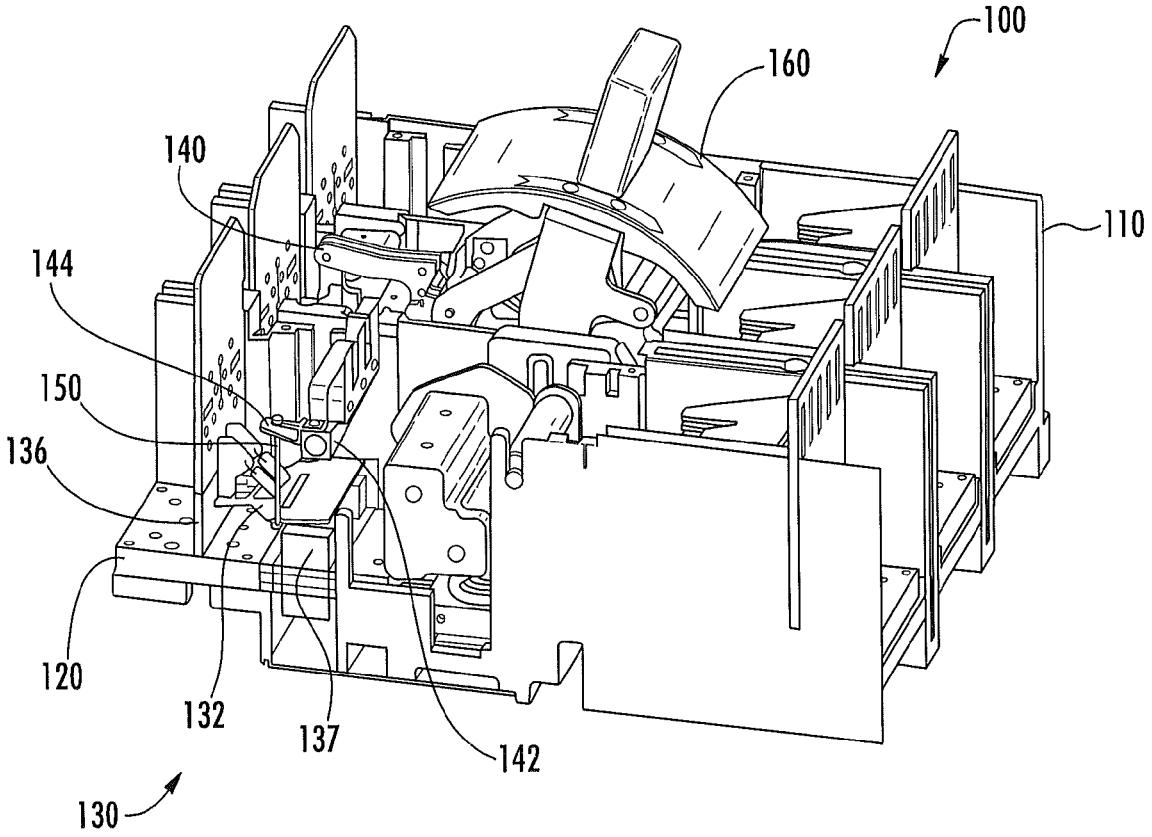
FIGS. 1 and 2 are different perspective views of a circuit breaker according to some embodiments of the inventive subject matter.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Figure 2:
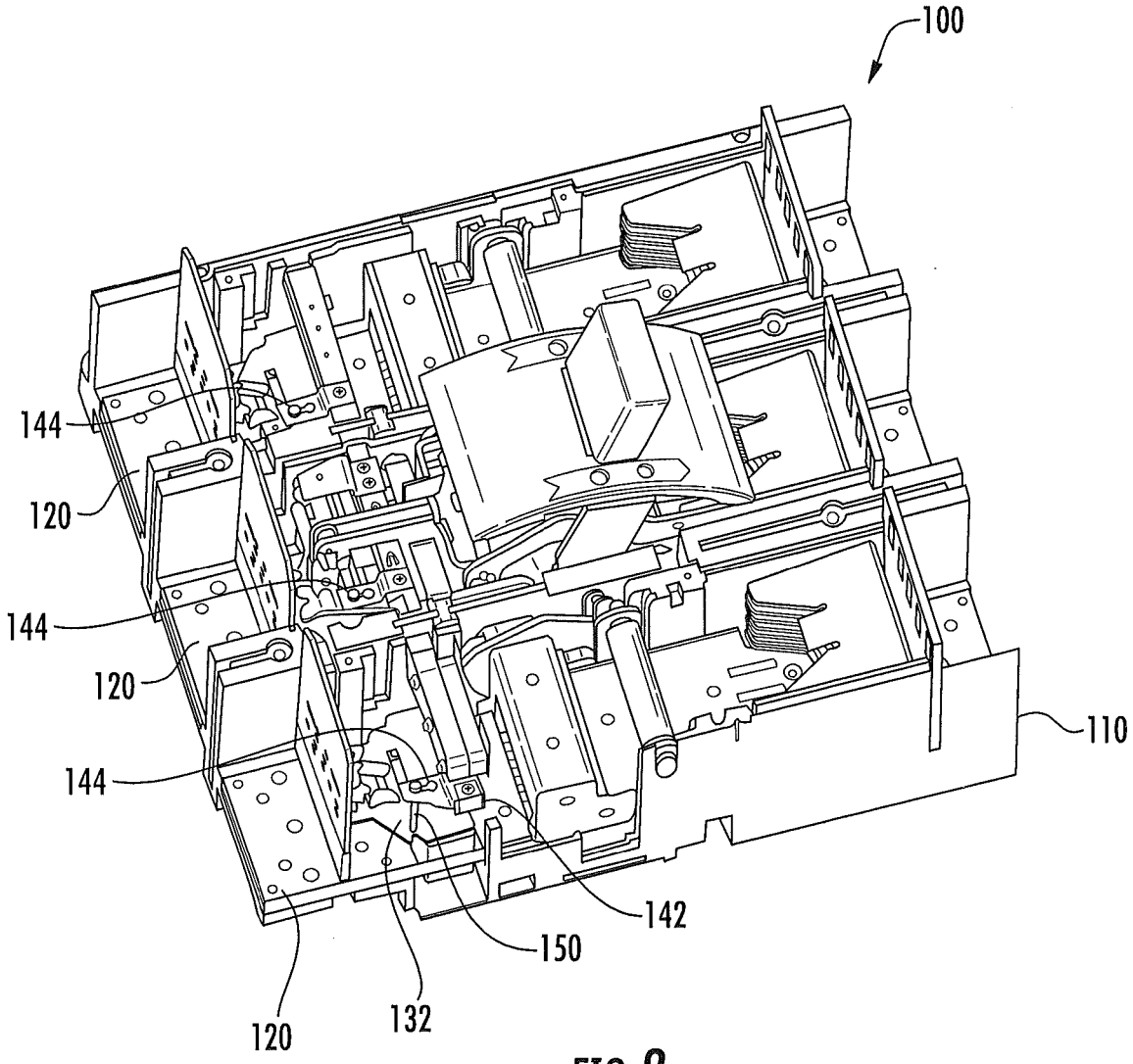

FIGS. 1-4 are perspective views illustrating portions of a circuit breaker 100 according to some embodiments. Referring to FIGS. 1 and 2, the circuit breaker 100 includes a frame 100, typically formed from a molded plastic material. Components supported by the frame 100 include a plurality of bus bar conductors 120 and a breaker mechanism 140, which may be manually actuated using a handle 160 and automatically actuated by magnetic armature assemblies 130 mechanically coupled to a trip bar 142. Each magnetic armature assembly 130 includes a spring-loaded armature plate 132 that is displaced by magnetic force generated by current passing through one of the bus bars 120 using flux linkage through an interposed magnet 137. The armature plate 132 is mechanically coupled to the trip bar 142 by an elongate link member, here shown as a cylindrical rod 150.

Figure 3:
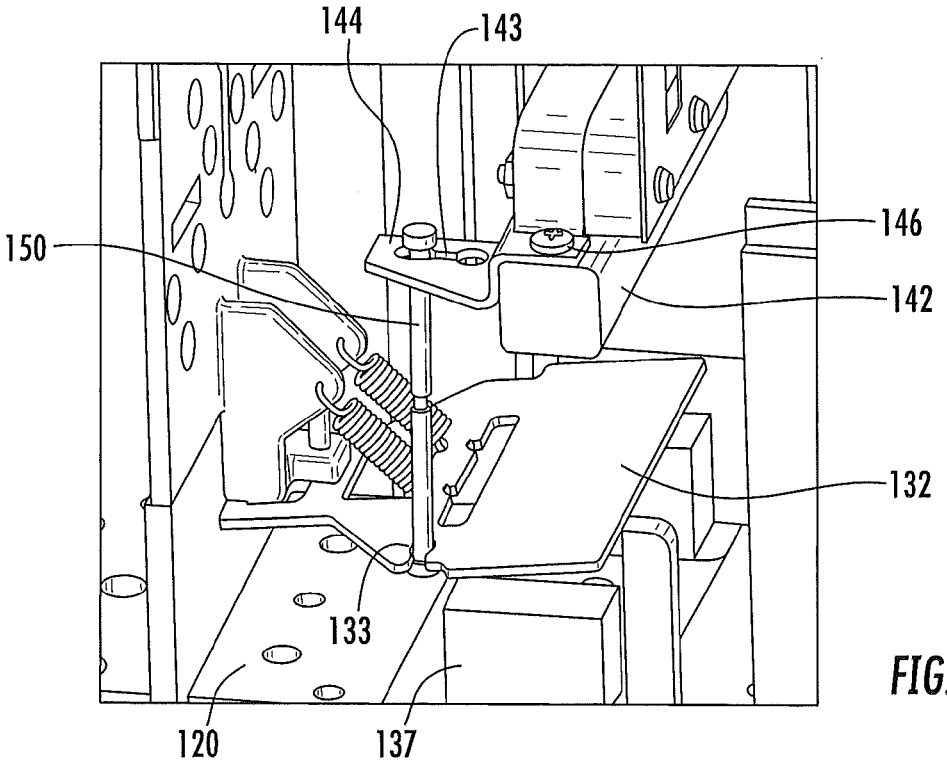
FIGS. 3 and 4 are detailed perspective views of the circuit breaker of FIGS. 1 and 2.
Figure 4:
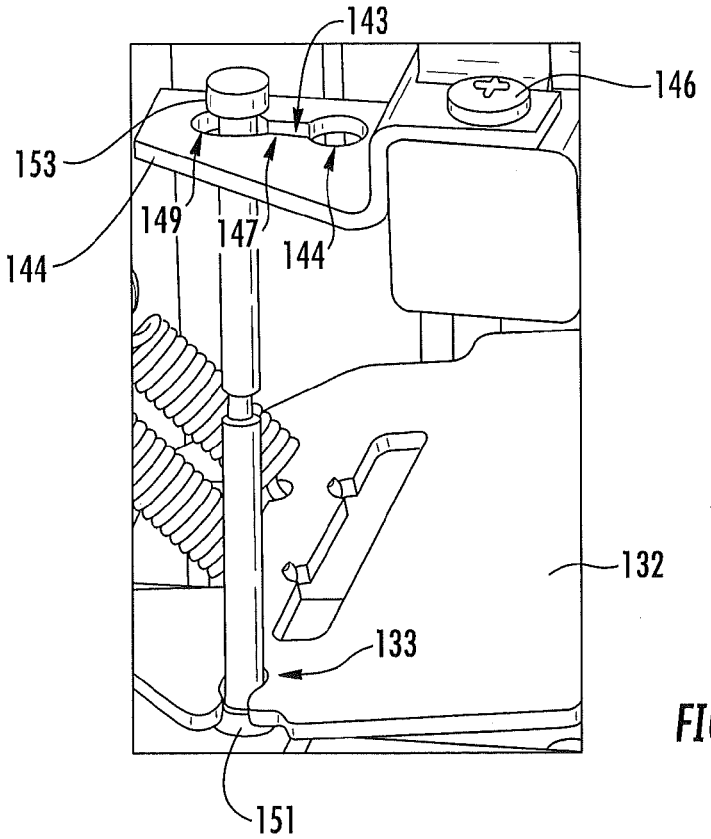

FIGS. 3 and 4 provide detailed views of the armature plate 132, trip bar 142 and linking rod 150. As shown, the armature plate 132 has a first keyed slot 133 defined therein that retains a first flanged end portion 151 of the rod 150. The rod 150 is mechanically coupled to the trip bar 142 using a trip bar bracket 144 having a second keyed slot 143 defined therein that retains a second flanged portion 153 of the rod 150. As shown, the trip bar bracket 143 is attached to the trip bar 142 using a screw 146, but it will be appreciated that other fasteners (releasable or non-releasable) may be used. As shown in FIG. 3, downward movement of the armature plate 132 due to magnetic force generated by current flow in the conductor 120 (and magnet 137) causes rotation of the trip bar 142, which, in turn, causes the breaker mechanism 140 to operate and open contacts of the breaker 100.

Referring to FIG. 4, the link rod 150 includes a narrowed portion 155 (e.g., a groove) defined between the first and second flanged end portions 151, 153. The narrowed portion 155 facilitates engagement of the rod 150 with the first and second keyed slots 133, 143 on the armature plate 132 and the trip bar bracket 144.

Figure 5:
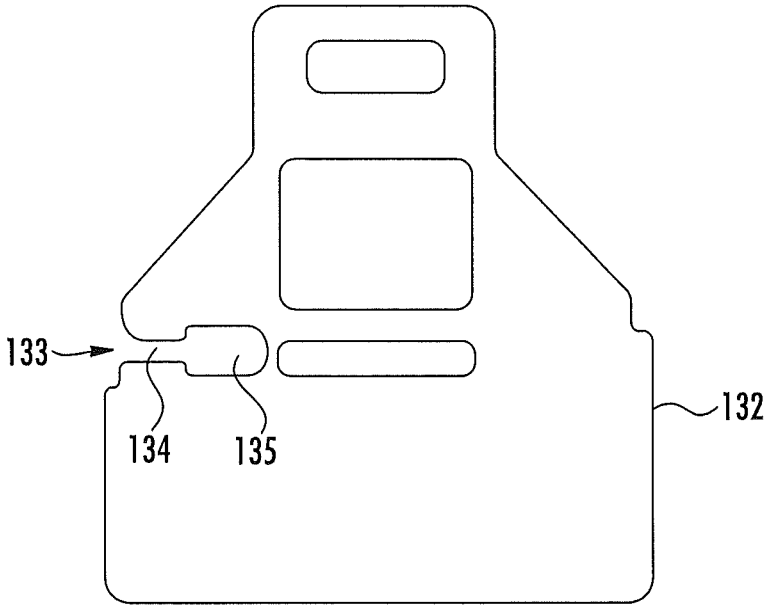
FIG. 5 is a plan view of an armature plate of the circuit breaker of FIGS. 1-4.

Referring to FIG. 5, which provides a plan view of the armature plate 132, the first keyed slot 133 is open at an edge of the armature plate 132 and includes a narrowed portion 134 that is configured to allow lateral passage of the narrowed portion 155 of the rod 150. Once the rod 150 is moved past this narrowed slot portion 134 and into an expanded portion 135, the rod 150 may be slid longitudinally through the expanded portion 135 of the slot 133 until the first flanged portion 151 is brought into contact with the armature plate 132. The enlarged portion 135 is sufficiently small to prevent passage of the first flanged portion 151 of the rod 150, and thus retains the first flanged portion 151 in the armature plate 132.

Figure 6:
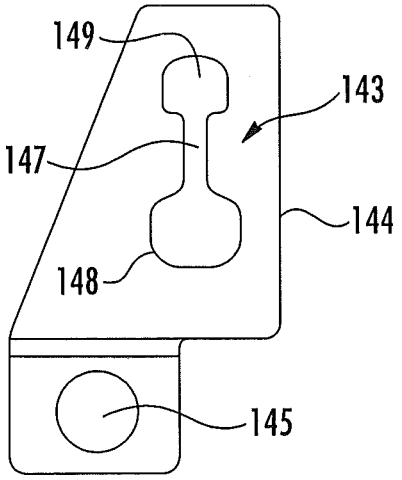
FIG. 6 is a plan view of a trip bar bracket of the circuit breaker of FIGS. 1-4.
Figure 7:
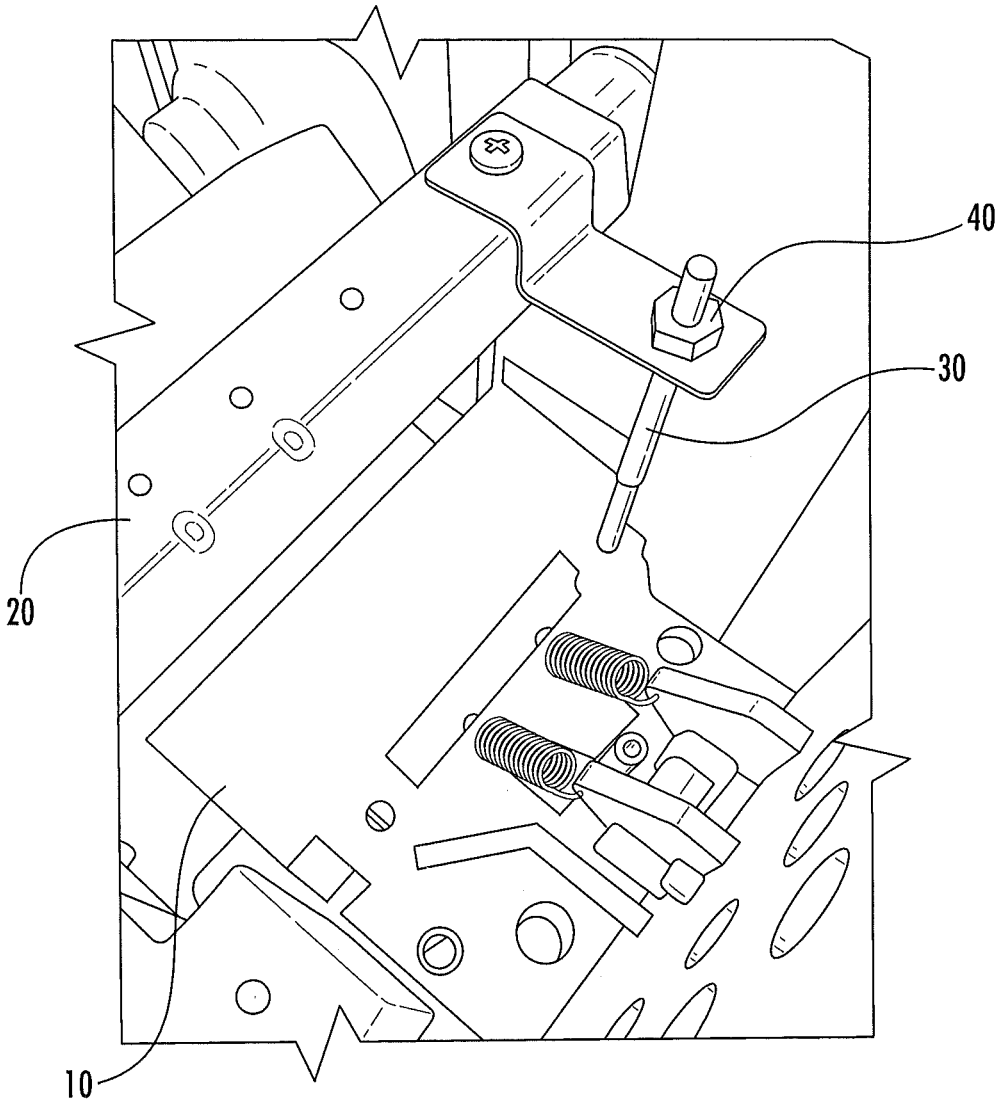
FIG. 7 PRIOR ART
FIGS. 7 and 8 illustrate conventional armature linkages.
Figure 8:
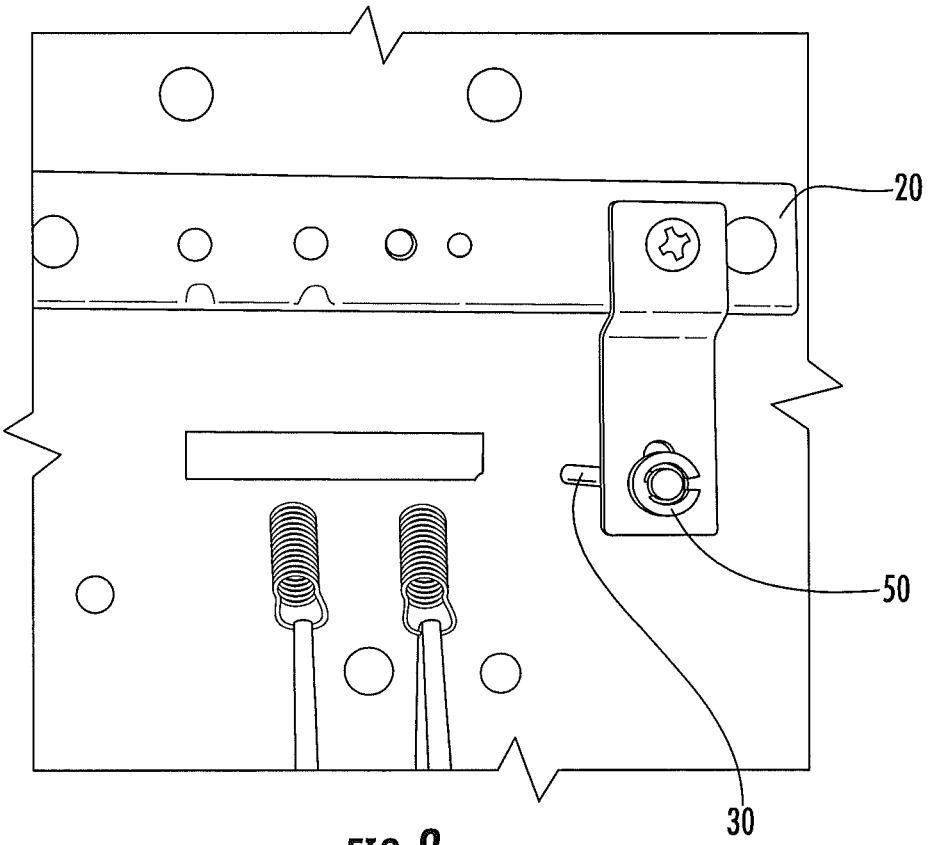
FIG. 8 PRIOR ART

Referring to FIG. 6, which provides a plan view of the trip bar bracket 144, the second keyed slot 143 has a "dumbbell" shape including first and second enlarged portions 148, 149 connected by a narrowed portion 147. The first enlarged portion 148 is sized to allow the second flanged portion 153 of the rod 150 to pass longitudinally therethrough. Once this end of the rod 150 is passed through the first enlarged portion 148 of the second keyed slot 143 and the rod slid through the first enlarge portion 148 of the second keyed slot 143 until the narrowed portion 155 of the rod is near the second keyed slot 143, the narrowed portion 155 of the rod 150 may be passed laterally through the narrowed portion 147 of the second keyed slot 143 and into the second enlarged portion 149 of the second keyed slot 143. The second enlarged portion 149 is sufficiently large to allow longitudinal movement of the rod 150 therein, while preventing longitudinal movement of the rod 150 past the second flanged portion 153, thus retaining the second flanged portion 153 of the rod 150 in the trip bar bracket 144.

During fabrication of the circuit breaker 100, installation of the rod 150 in the breaker 100 may occur as follows. With the trip bar bracket 144 initially detached from the trip bar 142, i.e., with the screw 146 removed, the rod 150 may be first engaged with the keyed slot 133 of the armature plate 132 by passing the narrowed portion 155 of the rod 150 through the narrowed portion 134 of the first keyed slot 133 and into the enlarged portion 135 of the first keyed slot 133. The rod 150 may then be moved longitudinally until the first flanged head 151 contacts the armature plate 132. The trip bar bracket 144 may then be coupled to the rod in a similar manner. In particular, the second flanged head 153 of the rod 150 may be inserted through first enlarged portion 148 of the second keyed slot 143 and then trip bar bracket 144 moved along the rod 150 to the point at which the narrowed portion 155 of the rod 150 may laterally pass through the narrowed portion 147 of the second keyed slot 143. The trip bar bracket 144 may then be moved along the rod 150 to the point at which the trip bar bracket 144 contacts the second flanged head 153 of the rod 150. The trip bar bracket 144 may then be attached to the trip bar 142 using the screw 146. Alternatively, the loose trip bar bracket 144 may be engaged with the rod 150 before engaging the rod 150 with the armature plate 132, followed by fastening of the trip bar bracket 144 to the trip bar 142.

Armature linkages along the lines described above offer several advantages. Because the link rod (e.g., the rod 150) has a fixed separation between its flanged portions and may be manufactured to have a precise length within predetermined tolerances, link adjustment may be eliminated. In addition, the assembly process may be greatly simplified and use simple tools.

It will be appreciated that the above-described structures and operations may be varied within the scope of the inventive subject matter. For example, although the illustrated embodiments illustrate an armature plate 132 having an open keyed slot 133, it will be appreciated that other configurations may be used, such as a dumbbell-shaped slot similar to the one provided in the trip bar bracket 144. While the illustrated embodiments use a link member in the form of a substantially straight rod 150, it will be understood that some embodiments may use an elongate link member with a different configuration, such as rod with an offset bend.

In the drawings and specification, there have been disclosed exemplary embodiments of the inventive subject matter. Although specific terms are employed, they are used in a generic and descriptive sense only and not for purposes of limitation, the scope of the inventive subject matter being defined by the following claims.

That which is claimed:

1. A circuit breaker comprising:

a frame;

at least one conductor supported by the frame;

a breaker mechanism supported by the frame and comprising a trip bar assembly that actuates the breaker mechanism;

a magnetic armature assembly comprising an armature plate configured to move responsive to a current in the at least one conductor; and an elongate link member coupling the armature plate to the trip bar and having at least one flanged portion retained in at least one keyed slot in at least one of the armature plate and the trip bar assembly, wherein the link member has a narrowed portion sized to allow passage of the link member through a narrowed portion of the at least one keyed slot and into an enlarged portion of the at least one keyed slot to engage the link member in the at least one keyed slot.

2. The circuit breaker of claim 1:

wherein the at least one keyed slot comprises a first keyed slot in the armature plate;

wherein the at least one flanged portion comprises a first flanged portion retained in the first keyed slot;

wherein the trip bar assembly comprises a trip bar and a trip bar bracket attached to the trip bar;

wherein the at least one keyed slot comprises a second keyed slot in the trip bar bracket; and wherein the at least one flanged portion comprises a second flanged portion retained in the second keyed slot.

3. The circuit breaker of claim 1, wherein the elongate link member comprises a rod and wherein the at least one flanged portion is positioned proximate an end of rod.

4. The circuit breaker of claim 3, wherein the at least one flanged portion comprises a first flanged portion proximate a first end of the rod and a second flanged portion proximate a second end of the rod.

5. The circuit breaker of claim 4, wherein the first flanged portion is retained in a first keyed slot in the armature plate.

6. The circuit breaker of claim 5, wherein the trip bar assembly comprises a trip bar and a trip bar bracket attached to the trip bar, and wherein the second flanged portion is retained in a second keyed slot in the trip bar bracket.

7. The circuit breaker of claim 6, wherein the rod has narrowed portion sized to allow passage of the link member through narrowed portions of the first and second keyed slots.

8. A circuit breaker comprising:

a frame;

at least one conductor supported by the frame;

a breaker mechanism supported by the frame and comprising a trip bar and a trip bar bracket attached to the trip bar;

a magnetic armature assembly supported by the frame and comprising an armature plate configured to move responsive to a current in the at least one conductor; and a rod having a first flanged portion positioned at a first end thereof and retained in a first keyed slot in the armature plate and a second flanged portion positioned at a second end of the rod and retained in a second keyed slot in the trip bar bracket, wherein the rod has narrowed portion configured to allow passage of the rod through narrowed portions and into enlarged portions of the first and second keyed slots.

9. The circuit breaker of claim 8, wherein a relationship of the narrowed portion to the first and second flanged portions inhibits disengagement of the first and second flanged portions from the first and second keyed slots when the trip bar bracket is attached to the trip bar.

10. The circuit breaker of claim 8, wherein the trip bar bracket is attached to the trip bar using a releasable fastener.

11. A method of fabricating a circuit breaker comprising:

engaging a flanged portion of an elongate link member in a keyed slot in an armature plate of an armature mechanism of the circuit breaker, including passing a narrowed portion of the elongate link member through a narrowed section and into an enlarged section of the keyed slot to engage the link member in the keyed slot; and attaching the elongate member to a trip bar of the circuit breaker to thereby mechanically couple the armature plate and the trip bar.

12. The method of claim 11:

wherein engaging the flanged portion of the elongate link member in the keyed slot in the armature plate comprises engaging a first flanged portion of the elongate link member in the keyed slot in the armature plate; and wherein attaching the elongate link member to the trip bar comprises:

engaging a second flanged portion of the elongate link member in a keyed slot in a trip bar bracket; and attaching the trip bar bracket to the trip bar.

13. The method of claim 12:

wherein engaging the second flanged portion of the elongate link member in the keyed slot in the trip bar bracket comprises passing the narrowed portion of the elongate link member through a narrowed section and into an enlarged section of the keyed slot in the trip bar bracket.

14. The method of claim 13, wherein the narrowed portion of the link member is positioned between the first and second flanged portions.

15. The method of claim 13, wherein the elongate link member comprises a rod, and wherein the first and second flanged portions are positioned at first and second ends of the rod.

16. The method of claim 12, wherein attaching the trip bar bracket to the trip bar comprises attaching the trip bar bracket to the trip bar using a releasable fastener.

* * * * *